United States Patent [19]

Fertig et al.

[11] Patent Number: 4,897,065

[45] Date of Patent: Jan. 30, 1990

[54] TOY VEHICLE AND HANDHELD PNEUMATIC LAUNCHER

[75] Inventors: John K. Fertig, Mount Prospect; Thomas P. McQueeny, Chicago; Howard J. Morrison, Riverwoods, all of Ill.

[73] Assignee: Marvin Glass & Associates, Chicago, Ill.

[21] Appl. No.: 302,887

[22] Filed: Jan. 30, 1989

[51] Int. Cl.[4] ..... A63H 27/14; A63H 3/31; A63H 29/00; A63B 71/00

[52] U.S. Cl. ..... 446/63; 446/196; 446/212; 446/429; 273/129 AP; 273/129 T; 124/63

[58] Field of Search ..... 446/63, 61, 34, 176, 446/180, 183, 185, 186, 187, 196, 197, 198, 211, 212, 230, 232, 429, 435; 124/56, 62, 63, 64, 65, 67; 273/129 R, 129 P, 129 AP, 129 S, 129 T, 108

[56] References Cited

U.S. PATENT DOCUMENTS

| | | | |
|---|---|---|---|
| 563,533 | 7/1896 | Wilmont | 124/64 X |
| 1,962,946 | 6/1934 | Andrews | 124/67 |
| 2,315,242 | 3/1943 | Briggs et al. | 446/63 |
| 2,991,782 | 7/1961 | Ayala | 446/211 X |
| 3,101,569 | 8/1963 | Giardina | 446/230 |
| 3,859,977 | 1/1975 | Lange | 124/66 |
| 4,076,006 | 2/1978 | Breslow et al. | 124/64 |
| 4,084,820 | 4/1978 | Olson, Jr. | 124/64 X |
| 4,236,345 | 12/1980 | Inoue | 446/197 |
| 4,411,249 | 10/1983 | Fogarty et al. | 446/211 X |

FOREIGN PATENT DOCUMENTS

| | | | |
|---|---|---|---|
| 633754 | 7/1936 | Fed. Rep. of Germany | 446/63 |
| 2261010 | 6/1973 | Fed. Rep. of Germany | 446/180 |

*Primary Examiner*—Robert A. Hafer
*Assistant Examiner*—D. Neal Muir
*Attorney, Agent, or Firm*—John S. Pacocha

[57] ABSTRACT

A toy vehicle and a handheld pneumatic launcher combination includes a piston and an elongated hollow cylinder with a flange adjacent one end of the cylinder providing grips for a child which simulate an airplane control yoke. While supporting lateral extensions of the flange with the fingers of each hand, the child's thumbs are free to press upon an actuator at one end of the piston forcing the piston head into the cylinder. Attached at the other end of the elongated cylinder, in pneumatic communication with the cylinder, is a launch tube that fits into a socket adjacent the bottom of a toy vehicle that is made predominantly of a lightweight plastic foam. The axis of the launch tube is preferably offset from the axis of the cylinder. In addition, the launch tube is tapered and has a closed end with perforations through the sidewalls of the tube adjacent the closed end.

17 Claims, 1 Drawing Sheet

TOY VEHICLE AND HANDHELD PNEUMATIC LAUNCHER

BACKGROUND OF THE INVENTION

1. Field the Invention

This invention relates generally to toy vehicles and more particularly to toy vehicles with pneumatic launchers.

2. Background Art

Pneumatic launchers for lightweight toy vehicles are old in the art. U.S. Pat. No. 4,076,006 issued Feb. 28, 1978 to Breslow et al. discloses a simple toy rocket pneumatic launcher including a generally flat base for positioning on a supporting surface such as a floor, table or the like; a flexible air impact bulb of a material adapted to withstand sudden impact by a user's hand or foot is mounted on the base and, through an integral conduit, is in pneumatic communication with a launching tube mounted on the base for pivotal movement. The child's own breath is used as the power source for the launching tube extending out from the base that is placed upon a horizontal supporting surface to lunch a toy car disclosed in U.S. Pat. No. 4,438,587 issued March 27, 1984 to Marino. Piston assemblies operated by a child hitting or pushing the top of the launcher are attached to bases supported on the floor and connected to track sections forming part of a game disclosed in U.S. Pat. No. 4,513,967 and 4,605,230 issued Apr. 30, 1985 and Aug. 12, 1986, respectively, to Halford et al. In U.S. Pat. No. 4,223,472. issued Sept. 23, 1980 to Fekete et al., a toy projectile launching device having a main tubular member in fluid communication with an air pump, an air storage tank and a projectile launching housing rotatably coupled to the main tubular member are all supported on a base. Carried by the base of U.S. Pat. No. 4,329,808 May 18, 1982 to Rich et al. is a paper airplane folding device and a pneumatic launcher for the completed airplane. However, there remains a need for a toy vehicle with a handheld pneumatic launcher that may be easily transported, aimed and used by a child.

SUMMARY OF THE INVENTION

The present invention is concerned with providing a toy vehicle and a handheld pneumatic launcher that includes an elongated hollow cylinder and piston. Adjacent one end of the cylinder, lateral extensions of a flange provide grips for a child which simulate an airplane control yoke. While supporting the lateral extensions with the fingers of each hand, the child's thumbs are free to press upon an actuator at one end of the piston forcing the piston head into the cylinder. Attached at the other end of the elongated cylinder, in pneumatic communication with the cylinder, is a launch tube that fits into a socket adjacent the bottom of a toy vehicle that is made predominantly of a lightweight plastic foam. The axis of the launch tube is preferably offset from the axis of the cylinder. In addition, the launch tube is tapered and has a closed end with perforations through the sidewalls of the tube adjacent the closed end.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figures 1, 2, 3, 4:
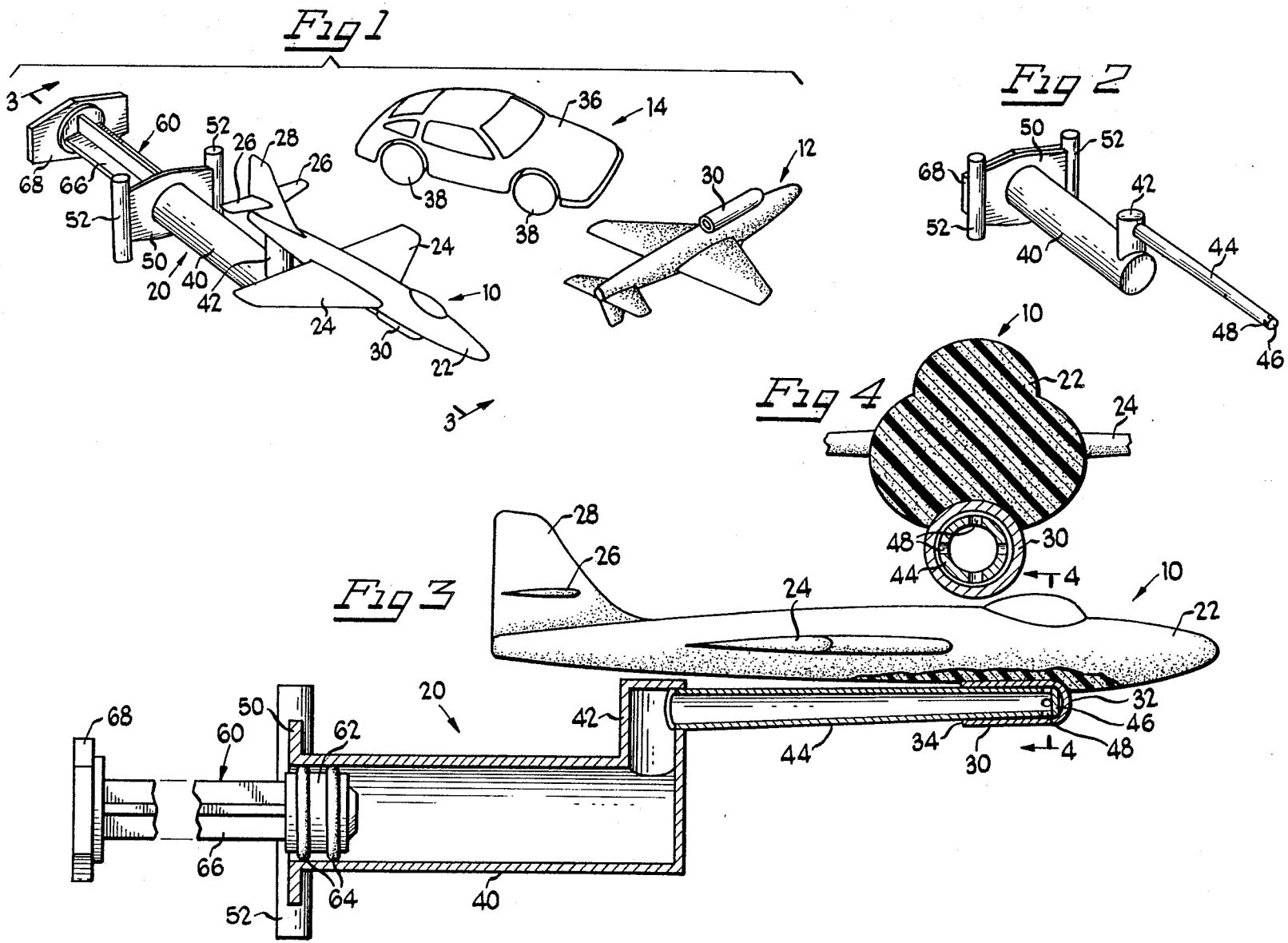
FIG. 1 is a perspective view of an embodiment of the present invention.
FIG. 2 is a perspective view of the pneumatic launcher by itself.
FIG. 3 is an enlarged scale, sectional view taken generally along line 3—3 of FIG. 1.
FIG. 4 is an enlarged scale, sectional view taken generally along line 4—4 of FIG. 3.

Referring now to the drawings in which like parts are designated by like reference numerals throughout the several views, FIG. 1 shows a variety of toy vehicles 10, 12 and 14 plus a pneumatic launcher 20 useable with all of the vehicles. A predominant portion of each of the toy vehicles is made of a lightweight plastic foam such as the relatively soft, spongy, porous polyurethane foam or a more rigid, molded styrofoam plastic. Thus, fuselage 22, wings 24, stabilizers 26 and rudder 28 of toy airplane 10 are all made of a lightweight plastic foam. Carried on the underside of toy airplane 10 is an elongated tubular socket 30 having a substantially uniform cross section, a closed end 32 and an open end 34. Socket 30 is preferably made of a more dense, rigid plastic such as styrene.

Toy airplane 12, which is shown turned over in FIG. 1, is similar in construction to toy airplane 10 except that it is of a smaller size. Like toy plane 10, toy plane 12 has a tubular socket 30 mounted on the underside of the plane. Toy car 14, like toy planes 10 and 12, is also made predominantly of a lightweight plastic foam; the entire chassis 36 of toy car 14 is made of a lightweight foam although the wheels 38 may be made of a more dense, rigid plastic. As with the toy airplanes, toy car 14 is provided with a tubular cylindrical socket 30. In the case of the toy car, socket 30 may be mounted in the back end of the car rather than on its underside. Accordingly, all of the toy vehicles are relatively safe for launching by a child.

Pneumatic launcher 20 includes an elongated hollow cylinder 40 that is closed at one end and open at the other end. Extending upwardly from the cylinder, as viewed in FIGS. 1–4, adjacent the closed end, is a relatively short conduit 42 that is substantially transverse to the axis of elongated cylinder 40. Conduit 42 is in fluid communication with cylinder 40 as is illustrated in FIG. 3. In fluid communication with conduit 42 and hence also with cylinder 40, is a tapered, hollow launching tube 44. The axis of tube 44 is offset from, rather than coincident with, the axis of cylinder 40. As is best illustrated in FIG. 3, tube 44, which is mounted above cylinder 40 as illustrated in FIGS. 1–4, is mounted at an angle to the cylinder such that the free end of tube 44 is at a slightly greater distance from cylinder 40 than is the end of the tube attached to conduit 42.

The free end 46 of tube 44 is closed. Spaced at generally equal intervals around the periphery of the side of tube 44 adjacent closed free end 46 are four perforations 48 that permit the passage of fluid or gas out of launching tube 44. Perforations 48 extend through the sidewall of tube 44 to permit the passage of fluid or gas out of the launching tube while prohibiting the insertion and subsequent launching of dangerous projectiles. For example, if the free end were not closed, a child might insert a pencil into launching tube 44 and shoot it at another child.

Extending out radially from adjacent the open end of cylinder 40 is a flange 50. As is best illustrated in FIGS. 1 and 2, flange 50 extends out laterally a greater distance than it does above and below the cylinder. At the extremity of each of the lateral extensions of flange 50 is an enlarged gripping portion 52 that is generally cylindrical. Each of cylindrical gripping portions 52 are substantially parallel to each other and to conduit 42. Flange 50, with its cylindrical gripping portions 52, is designed to resemble the control yoke of an airplane or the controls of certain electronic games which are gripped like an airplane control yoke and leave the thumbs of the player free to press firing buttons.

Receivable in hollow cylinder 40 through its open end is a piston 60. At the forward end of piston 60 is a cylindrical head 62 on which a pair of spaced apart rubber O-rings 64 are attached to maintain piston 60 in gas tight relationship with cylinder 40. Extending away from head 62 and cylinder 40 is a stem 66. At the end of stem 66 opposite head 62 is an actuator tab 68. As is best illustrated in FIG. 1, actuator tab 68 generally conforms in shape to flange 50.

To use pneumatic launcher 20, a toy vehicle is first loaded on the launcher. With a toy airplane, or other simulated flying toy, launcher 20 is oriented with conduit 42 pointing upwardly and launch tube 44 lying above cylinder 40. When a larger toy airplane such as 10 is seated for launching on tube 44, a portion of the plane will overlie cylinder 40, as is best illustrated in FIGS. 1 and 3. For launching toy cars, launcher 20 may be turned over one hundred eighty degrees so that conduit 42 is directed downwardly and tube 44 lies below cylinder 40. Because tube 44 is conical or tapered, it provides a gripping fit with cylindrical socket 30 as is best illustrated in FIG. 3. To prevent too tight of a fit, socket 30 is of a limited length, relative to the taper of tube 44, such that the tube will engage closed end 32 of the socket before the fit becomes too tight. Alternatively, tube 44 could be provided with a flange (not shown) spaced back from free end 46 to limit the length of the tube that may be inserted into socket 30. Without some limitation on the length of tube 44 that may be inserted into socket 30, the gripping fit could be made so tight that the vehicle could not be launched.

After loading the toy vehicle on the launching tube, the user holds launcher 20 by placing the fingers of each hand around the front of cylindrical gripping portions 52 and flange 50 such that the fingers are on the side of flange 50 facing toward the launching tube. With the user's fingers around the gripping portion and flange, the thumbs of the user's hands are placed on the back free side of piston actuator tab 68. Because of the gas tight relationship between piston head 62 with its O-ring 64 and the interior of cylinder 40, the force exerted between the user's thumbs on actuator 68 and the fingers gripping flange 50 is sufficient to provide support and control of launcher 20 by the user such that the user may orient and aim the launcher.

Toy airplanes and the like on the launching tube may be employed as sights for aiming them at an intended target. As a result of the gripping fit between tapered tube 34 and tubular socket 30, plus the light weight of the toy vehicles, the vehicles are stably supported on the launching tube in various attitudes of orientation of launcher 20. To launch the plane, the user increases the thumb pressure on actuator 68 to force piston 60 down into tube 40 compressing the air in cylinder 40, conduit 42 and tube 44. As the compressed air is expelled out through perforations 48, pressure builds up within socket 30 overcoming the gripping force between socket 30 and tapered launch tube 44 to pneumatically launch the toy airplane.

While a particular embodiment of the present invention has been shown and described with some variations, other variations and modifications will occur to those skilled in the art. It is intended in the appended claims to cover all such variations and modifications as fall within the true spirit and scope of the present invention.

What is claimed as new and desired to be secured by Letters Patent is:

1. A toy vehicle and a handheld pneumatic launcher comprises in combination:

a toy vehicle made predominantly of a lightweight plastic foam;

the toy vehicle including means for receiving a launching tube;

an elongated hollow cylinder having an axis and opposed ends;

one of the opposed ends of the cylinder being open and the other closed;

a flange extending outwardly from either side of the cylinder adjacent the open end of the cylinder for a user to manually grasp the cylinder;

the launching tube having an attached end and a free end;

the attached end of the launching tube being connected to the cylinder adjacent the closed end of the cylinder, in general alignment with the cylinder as opposed to generally transverse to the cylinder and in pneumatic communication with the cylinder;

an elongated piston having a forward end and a rearward end;

the piston having a head at the forward end that fits into the cylinder in gas tight relationship with the cylinder;

means adjacent the rearward end of the piston facilitating actuation of the piston; and the flange for grasping the cylinder and the means for actuating the piston cooperating to permit a user to grasp the cylinder with the fingers of each of the user's hands while using the thumbs on the actuating means to help support and aim the launcher as well as to push the piston into the cylinder.

2. The toy vehicle and handheld pneumatic launcher of claim 1 in which:

the launching tube has an axis that is offset from the axis of the cylinder; and the axes of the tube and cylinder are parallel or at an acute angle, rather than transverse, to each other.

3. The toy vehicle and handheld pneumatic launcher of claim 2 in which the launching tube is tapered from the attached end to the free end.

4. The toy vehicle of claim 3 in which the tube receiving means is a closed end cylindrical socket of a limited length, relative to the taper of the tube, so that the tube will engage the closed end before the fit between the socket and the tube becomes too light to permit the toy vehicle to be launched from the tube.

5. The toy vehicle and handheld pneumatic launcher of claim 4 in which:

the free end of the launching tube is closed and a number of openings extend through the launching tube adjacent the closed free end;

the launching tube has an axis and sidewalls tapering toward the axis at the free end; and the openings extend through the sidewalls.

6. The toy vehicle and handheld pneumatic launcher of claim 3 in which:

the free end of the launching tube is closed and a number of openings extend through the launching tube adjacent the closed free end;

the launching tube has an axis and sidewalls tapering toward the axis at the free end; and the openings extend through the sidewalls.

7. The toy vehicle and handheld pneumatic launcher of claim 2 in which:

the cylinder has a top;

the launching tube is attached adjacent the top of the cylinder;

the launching tube extends forward of the cylinder but does not extend back along the cylinder to the open end;

the toy vehicle has a front and a back with the length of the toy vehicle between the front and the back being greater that the length of the launching tube;

the means for receiving the launching tube is adjacent the front of the toy vehicle; and a portion of the toy vehicle lies over the cylinder when the launching tube is in the receiving means.

8. The toy vehicle and handheld pneumatic launcher of claim 7 in which the launching tube is tapered from the attached end to the free end.

9. The toy vehicle of claim 8 in which the tube receiving means is a closed end cylindrical socket of a limited length, relative to the taper of the tube, so that the tube will engage the closed end before the fit between the socket and the tube becomes too tight to permit the toy vehicle to be launched from the tube.

10. The toy vehicle and handheld pneumatic launcher of claim 9 in which:

the free end of the launching tube is closed and a number of openings extend through the launching tube adjacent the closed free end;

the launching tube an axis and sidewalls tapering toward the axis at the free end; and the openings extend through the sidewalls.

11. The toy vehicle and handheld pneumatic launcher of claim 8 in which the free end of the launching tube is closed and a number of perforations extend through the launching tube adjacent the closed free end.

12. The toy vehicle and handheld pneumatic launcher of claim 1 in which the launching tube is tapered from the attached end to the free end.

13. The toy vehicle of claim 12 in which the tube receiving means is a closed end cylindrical socket of a limited length, relative to the taper of the tube, so that the tube will engage the closed end before the fit between the socket and the tube becomes too tight to permit the toy vehicle to be launched from the tube.

14. The toy vehicle and handheld pneumatic launcher of claim 13 in which:

the free end of the launching tube is closed and a number of openings extend through the launching tube adjacent the closed free end;

the launching tube has an axis and sidewalls tapering toward the axis at the free end; and the openings extend through the sidewalls.

15. The toy vehicle and handheld pneumatic launcher of claim 12 in which:

the free end of the launching tube is closed and a number of openings extend through the launching tube adjacent the closed free end;

the launching tube has an axis and sidewalls tapering toward the axis at the free end; and the openings extend through the sidewalls.

16. The toy vehicle and handheld pneumatic launcher of claim 1 in which:

the free end of the launching tube is closed and a number of openings extend through the launching tube adjacent the closed free end;

the means for receiving the launching tube comprises a closed end cylindrical socket;

the launching tube has an axis and sidewalls tapering toward the axis at the free end; and the openings extend through the sidewalls.

17. A toy vehicle and a handheld pneumatic launcher comprising in combination:

a toy vehicle made predominantly of a lightweight plastic foam;

the toy vehicle including a closed end cylindrical socket for receiving a launching tube;

an elongated hollow cylinder having an axis and opposed ends;

means extending outwardly from the cylinder for a user to manually grasp the cylinder;

the launching tube having an attached end and a free end;

the attached end of the launching tube being connected to the cylinder adjacent one end of the cylinder in pneumatic communication with the cylinder;

an elongated piston having a forward end and a rearward end;

the piston having a head at the forward end that fits into the cylinder in gas tight relationship with the cylinder;

means adjacent the rearward end of the piston facilitating actuation of the piston;

the launched tube being tapered from the attached end to the free end;

the launching tube having an axis and sidewalls tapering toward the axis at the free end; and the free end of the launching tube being closed and having a number of openings extend through the sidewalls of the launching tube adjacent the closed free end with the openings having axes that are substantially transverse to the axis of the tube.

* * * * *